US005458190A

United States Patent [19]

Sasaki et al.

[11] Patent Number: 5,458,190

[45] **Date of Patent: * Oct. 17, 1995**

[54] CONDENSER

[75] Inventors: Hironaka Sasaki; Ryoichi Hoshino; Takayuki Yasutake, all of Oyamashi, Japan

[73] Assignee: Showa Aluminum Corporation, Osaka, Japan

[ * ] Notice: The portion of the term of this patent subsequent to May 2, 2006 has been disclaimed.

[21] Appl. No.: 339,064

[22] Filed: Nov. 14, 1994

Related U.S. Application Data

[63] Continuation of Ser. No. 946,817, Sep. 16, 1992, abandoned, which is a continuation of Ser. No. 692,826, Apr. 26, 1991, abandoned, which is a continuation of Ser. No. 355,984, May 22, 1989, abandoned, which is a continuation-in-part of Ser. No. 328,896, Mar. 27, 1989, Pat. No. 4,936,379, which is a division of Ser. No. 77,815, Jul. 27, 1987, Pat. No. 4,825,941.

[30] Foreign Application Priority Data

Jul. 29, 1986 [JP] Japan ..... 61-179763
Nov. 4, 1986 [JP] Japan ..... 61-263138

[51] Int. Cl.[6] ..... F28B 1/06; F28F 1/02

[52] U.S. Cl. ..... 165/110; 165/150; 165/174

[58] Field of Search ..... 165/76, 110, 146, 165/150, 153, 173, 174, 176, 177

[56] References Cited

U.S. PATENT DOCUMENTS

| | | | |
|---|---|---|---|
| 131,779 | 10/1872 | Pitts et al. . | |
| 1,078,271 | 11/1913 | Force et al. . | |
| 1,438,596 | 12/1922 | Harding | 165/173 |
| 1,958,226 | 5/1934 | Askin | 257/255 |
| 2,004,390 | 6/1935 | Benzinger | 257/32 |
| 2,200,788 | 5/1940 | Coy | 257/28 |
| 2,310,234 | 2/1943 | Haug . | |
| 2,573,161 | 10/1951 | Tadewald | 257/130 |
| 2,867,416 | 1/1959 | Lieberherr | 257/248 |
| 3,307,622 | 3/1967 | Oddy | 165/151 |
| 3,310,869 | 3/1967 | LaPorte et al. | 29/157.3 |
| 3,416,600 | 12/1968 | Fink | 165/177 |
| 3,524,500 | 8/1970 | Benjumeda et al. | 165/129 |
| 3,675,710 | 7/1972 | Ristow | 165/1 |
| 3,689,972 | 9/1972 | Mosier et al. | 29/157.3 |
| 3,759,321 | 9/1973 | Ares | 165/125 |
| 3,860,038 | 1/1975 | Forni | 138/94.3 |
| 3,976,126 | 8/1976 | Ruff | 165/110 |
| 4,141,409 | 2/1979 | Woodhull, Jr. et al. | 165/110 |
| 4,201,263 | 5/1980 | Anderson | 165/146 |
| 4,209,059 | 6/1980 | Anthony et al. | 165/1 |
| 4,330,034 | 5/1982 | Lang et al. | 165/113 |
| 4,332,293 | 6/1982 | Hiramatsu | 165/153 |
| 4,443,921 | 4/1984 | Allemandou | 165/177 X |
| 4,569,390 | 2/1986 | Knowlton et al. | 165/149 |
| 4,570,700 | 2/1986 | Ohara et al. | 165/134.1 |
| 4,615,385 | 10/1986 | Saperstein et al. | 165/175 |
| 4,688,311 | 8/1987 | Saperstein et al. | 29/157.3 |
| 4,693,307 | 9/1987 | Scarselletta | 165/152 |

(List continued on next page.)

FOREIGN PATENT DOCUMENTS 65546 8/1947 Denmark .

(List continued on next page.)

OTHER PUBLICATIONS

Patent abstract of Japan, vol. 8, No. 76 (M–288) [1513], 9th Apr. 1984; & JA–A–58 221 393.

*Primary Examiner*—Allen J. Flanigan

[57] ABSTRACT

A condenser for use in air conditioning systems, including a core and headers, the core comprising tubes and corrugated fins sandwiched between the tubes, wherein:

width of each tube: 6.0 to 20 mm
height of each tube: 1.5 to 7.0 mm
height of each cooling
medium flow path: 1.0 mm or more
height of each fin: 6.0 to 16 mm
fin pitch: 1.6 to 4.0 mm

8 Claims, 3 Drawing Sheets

U.S. PATENT DOCUMENTS

| | | | |
|---|---|---|---|
| 4,730,669 | 3/1988 | Beasley et al. | 165/151 |
| 4,766,953 | 8/1988 | Grieb et al. | 165/177 |
| 4,825,941 | 5/1989 | Hoshino et al. | 165/110 |
| 4,998,580 | 3/1991 | Guntly et al. | 165/133 |

FOREIGN PATENT DOCUMENTS

| | | |
|---|---|---|
| 0002687 | 7/1979 | European Pat. Off. . |
| 0138435 | 4/1985 | European Pat. Off. . |
| 0219974 | 4/1987 | European Pat. Off. . |
| 0255313 | 2/1988 | European Pat. Off. . |
| 1265756 | 5/1961 | France . |
| 1431920 | 2/1966 | France . |
| 2287963 | 3/1977 | France . |
| 2367996 | 5/1978 | France . |
| 2390694 | 12/1978 | France . |
| 2478807 | 9/1981 | France . |
| 2574175 | 6/1986 | France . |
| 2025207 | 12/1971 | Germany . |
| 2129965 | 12/1971 | Germany . |
| 2238858 | 3/1973 | Germany . |
| 2603968 | 8/1977 | Germany . |
| 3005751 | 8/1981 | Germany . |
| 3206298 | 10/1982 | Germany . |
| 3423746 | 1/1986 | Germany . |
| 3536325 | 5/1986 | Germany . |
| 48-49054 | 7/1973 | Japan . |
| 48-100746 | 12/1973 | Japan . |
| 49-114145 | 10/1974 | Japan . |
| 54-17158 | 2/1979 | Japan . |
| 55-10072 | 1/1980 | Japan . |
| 55-72795 | 5/1980 | Japan . |
| 55-100963 | 7/1980 | Japan . |
| 56-149295 | 11/1981 | Japan . |
| 57-38169 | 3/1982 | Japan . |
| 57-66389 | 4/1982 | Japan . |
| 57-87576 | 6/1982 | Japan . |
| 57-198992 | 12/1982 | Japan . |
| 58-221390 | 12/1983 | Japan . |
| 59-19880 | 6/1984 | Japan . |
| 59-37564 | 10/1984 | Japan . |
| 59-173693 | 10/1984 | Japan . |
| 59-181997 | 12/1984 | Japan . |
| 60-91977 | 6/1985 | Japan . |
| 60-101483 | 6/1985 | Japan . |
| 60-191858 | 6/1985 | Japan . |
| 61-93387 | 5/1986 | Japan . |
| 61-114094 | 5/1986 | Japan . |
| 63-34466 | 2/1988 | Japan . |
| 1601954 | 11/1981 | United Kingdom . |
| 2090652 | 7/1982 | United Kingdom . |
| 2167850 | 6/1986 | United Kingdom . |
| WO8401208 | 3/1984 | WIPO . |

CONDENSER

This application is a continuation of application Ser. No. 946,817, filed Sep. 16, 1992, now abandoned, which is a continuation of Ser. No. 692,826, filed Apr. 26, 1991, now abandoned, which is a continuation of Ser. No. 355,984, filed May 22, 1989, now abandoned, which is a continuation-in-part of Ser. No. 328,896, filed Mar. 27, 1989 (U.S. Pat. No. 4,936,379), which is a division of Ser. No. 077,815, filed Jul. 27, 1987 (U.S. Pat. No. 4,825,941).

BACKGROUND OF THE INVENTION

The present invention relates to a condenser for use in automobile and building air conditioning systems.

For such use, a "serpentine" type of condenser is well known and widely used. This type of condenser is made up of a flat multi-bored tube, commonly called a "harmonica tube", bent in a few folds, and corrugated fins sandwiched between the folded walls.

One of the disadvantages of the serpentine type condensers is that the coolant undergoes a relatively large pressure loss while flowing through the flat tube. To reduce the pressure loss, the common practice is to minimize fin pitches, widen the tube width to increase the cross-sectional area of the coolant flow paths, and increase the density of fins disposed between the folded tube walls.

However, as the tube is widened, its rigidity increases, and therefore it becomes difficult to bend. In addition, there is a limitation to the bent of a tube in terms of radius of curvature. In short, the heat exchange efficiency cannot be increased only by reliance upon the increased density of fins packed between the folds of tube.

Accordingly, it is an object of the present invention is to provide a condenser capable of easy construction with the flexibility in the width of the tubes, and the height of fins.

Another object of the present invention is to provide a condenser which minimizes the pressure loss of a cooling medium and air passing through the tubes and fins, thereby enhancing the efficiency of heat exchange.

Other objects and advantages of the present invention will become more apparent from the following detailed description, when taken in conjunction with the accompanying drawings which show, for the purpose of illustration only, one embodiment in accordance with the present invention.

SUMMARY OF THE INVENTION

According to the present invention, there is provided a condenser comprising tubes arranged in parallel with each other, and corrugated fins sandwiched between one tube and the next, the tubes being connected to headers at each end thereof so as to form a cooling medium flow path, wherein the following dimensional relationship is established:

width of each tube: 6.0 to 20 mm height of each tube: 1.5 to 7.0 mm height of each cooling medium flow path: 1.0 mm or more height of each fin: 6.0 to 16 mm fin pitch: 1.6 to 4.0 mm According to another aspect of the present invention, there is provided a condenser comprising tubes arranged in parallel with each other, and corrugated fins sandwiched between one tube and the next, the tubes being connected to headers at each end thereof so as to form a cooling medium flow path, wherein the following dimensional relationship is established:

width of each tube: 6.0 to 16 mm height of each tube: 1.5 to 5.0 mm height of each cooling medium flow path: 1.0 mm or more height of each fin: 8.0 to 16 mm fin pitch: 1.6 to 3.2 mm According to a further aspect of the present invention, there is provided a condenser comprising tubes arranged in parallel with each other, and corrugated fins sandwiched between one tube and the next, the tubes being connected to headers at each end thereof so as to form a cooling medium flow path, wherein the following dimensional relationship is established:

width of each tube: 10 to 14 mm height of each tube: 2.5 to 4.0 mm height of each cooling medium flow path: 1.5 to 2.0 mm height of each fin: 8.0 to 12 mm fin pitch: 2.0 to 3.2 mm

DETAILED DESCRIPTION OF THE PREFERRED EMBODIMENT

Referring to FIGS. 1 to 6, the illustrated condenser includes a plurality of flat tubes 1 stacked in parallel and corrugated fins 2 sandwiched between the tubes 1. The terminating ends of the tubes 1 are connected to headers 3 and 4.

Figure 3:
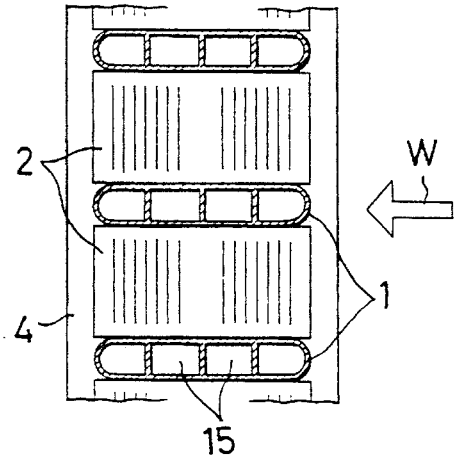
FIG. 3 is a cross-sectional view on an enlarged scale taken along the line 3—3 of FIG. 1.
Figure 5:
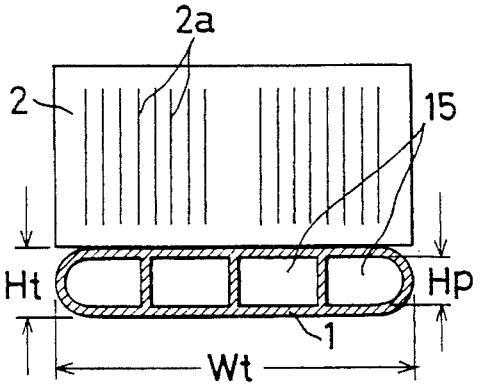
FIG. 5 is a fragmentary cross-sectional view on an enlarged scale corresponding to FIG. 3.
Figure 6:
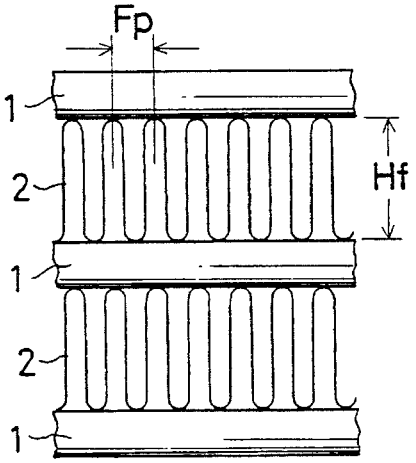
FIG. 6 is a diagrammatic front view showing a relationship between the corrugated fins and the flat tubes.

Each tube is made of extruded aluminum, having a flat configuration as clearly shown in FIGS. 3 and 5. Each tube 1 is multi-bored, that is, having many bores 15. The end portions 1*a* of each tube 1 has a step 5, which means that the end portions la of the tube 1 has a smaller diameter than that of the main body. The reference numeral 1*b* designates a recess adapted to allow the corrugated fins 2 to stay stably on the tube 1. The terminating end of each tube 1 is tapered so as to be smoothly inserted in holes 6 of the headers 3 and 4. The tubes 1 can be made of extrusions or electrically seamed pipes.

Preferably the corrugated fin 2 is made of an aluminum core sheet coated with a brazing substance on one surface or both surfaces, having a width identical with that of the tube 1. The fins 2 and the tubes 1 are brazed to each other. Preferably the fins 2 are provided with louvers 2*a* on the surface.

Figure 4:
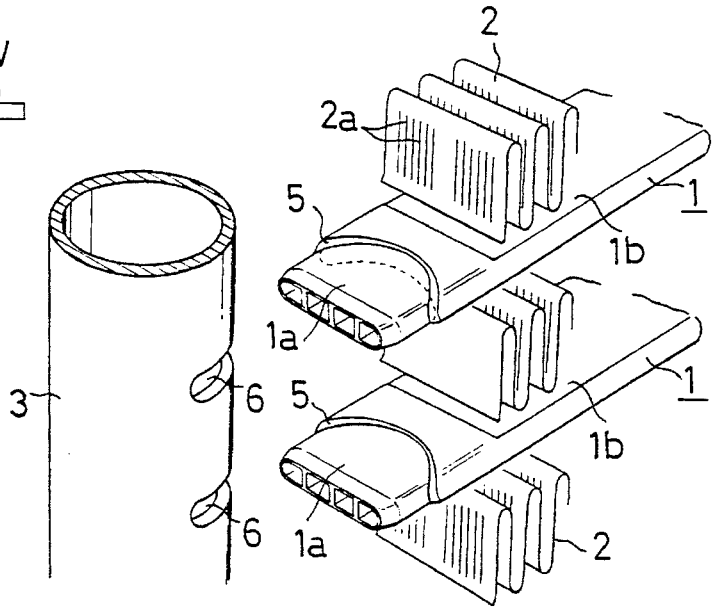
FIG. 4 is an exploded perspective view of the condenser of FIG. 1.
Figure 8:
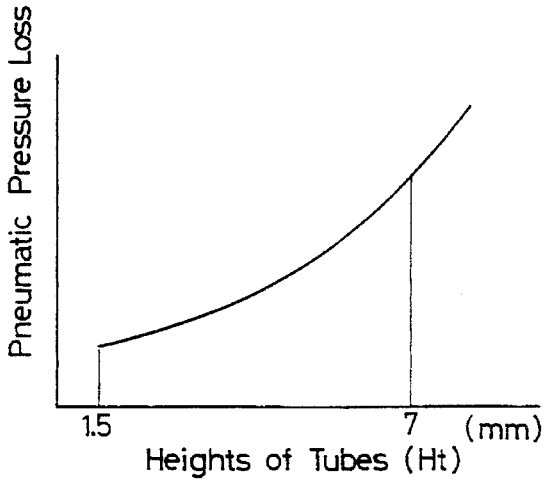
FIG. 8 is a graph showing a relationship between the heights of the flat tubes and the pneumatic pressure loss.

The headers 3, 4 are made up of electrically seamed pipe which is made of a brazing aluminum sheet. The brazing aluminum sheet is made of a core aluminum sheet coated with a brazing substance on one surface or on both surfaces. The holes 8 of the headers 3, 4 have the same shape as the cross-section of the tubes 1 so as to enable the tapered ends la of the tubes to fit therein. As shown in FIGS. 5 and 8, the tubes 1 are inserted in the holes 6 until the steps 5 of the tubes 1 come into abutment with the walls of the headers 3, 4, thereby preventing the tubes 1 from being inserted too far into the headers 3, 4. The tubes 1 are brazed to the headers 3, 4. Preferably, the steps 5 have a semi-circular inner face as shown in FIG. 4, thereby ensuring that the steps 5 keep contact with the profile of the header walls with no gap existing therebetween. Non-gap contact ensures the liquidtight joint between the headers 3, 4 and the tubes 1.

Figure 1:
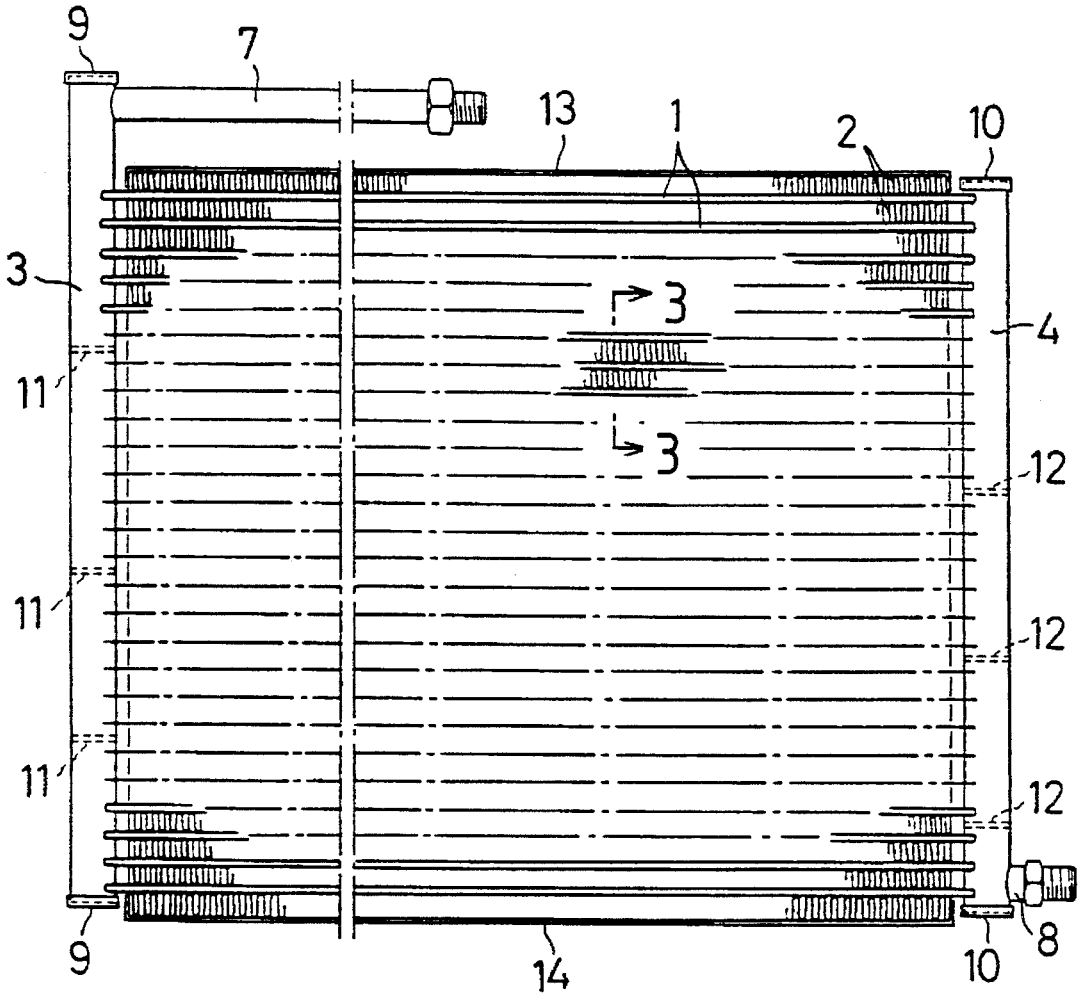
FIG. 1 is a plan view of a condenser according to the present invention.
Figure 2:
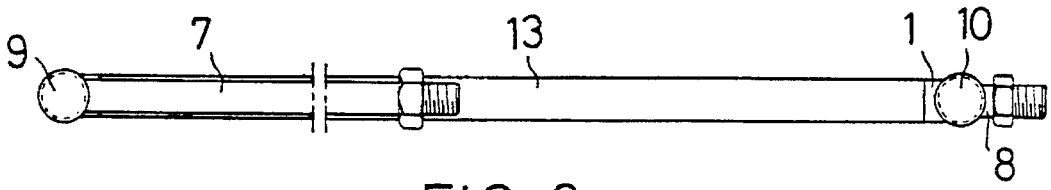
FIG. 2 is a plan view of the condenser.

In FIG. 1, the left-hand header 3 is connected to an inlet 7 through which a cooling medium is taken in, and the right-hand header 4 is connected to an outlet 8 through which the used cooling medium is discharged. Each end of the headers 3, 4 is closed by a plug 9, 10. The inner spaces of the header 3 and 4 are divided into four sections by partitions 11 and 12, respectively. The cooling medium introduced through the inlet 7 flows through the whole tubes 1 in the zigzag pattern and is discharged through the outlet 8. By providing the partitions 11, 12 the rate of the cooling medium is varied for the whole passage provided by the tubes 1. It is arranged that the effective cross-sectional areas of the cooling medium flow paths are progressively reduced from the inlet 7 toward a middle portion of the headers 3, 4 and are constant from the middle portion toward the outlet 8. Air passes through the fins 2 in the direction of arrow in FIG. 3, in the course of which heat is exchanged between the cooling medium and the air. In FIG. 1 the reference numerals 13 and 14 designate side plates secured to the outermost corrugated fins.

The steps 5 of the tubes 1 are shaped by a hammer or any other known tools. For example, a shaving method or a sizing method can be used. The shaving method and the sizing method can be used in combination. In the illustrated embodiment the steps 5 are a continuous semi-circle, but one or more projections can be formed on the surface of each tube so as to serve as stops.

Figure 7:
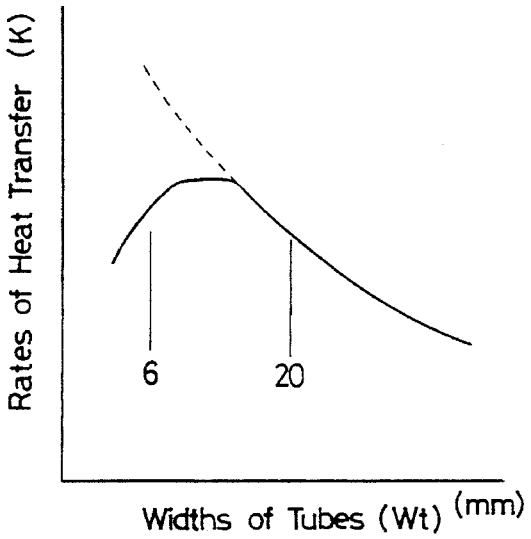
FIG. 7 is a graph showing a relationship between the widths of the flat tubes and the rates of heat transfer.

The degree of the pressure loss which the cooling medium and the air undergo while passing through the tubes 1 and the fins 2, and the resulting decrease in heat exchange efficiency largely depend upon the design and dimensional specifications of the tubes and fins. The inventors have found that optimum conditions are achieved when the tubes have a width (Wt) of 6.0 to 20 mm, a height (Ht) of 1.5 to 7.0 mm, and a path 12 of the cooling medium has a height (Hp) of 1.0 mm or more, and each fin 2 has a height (Hf) of 6.0 to 16 mm, and a pitch (Fp) of 1.6 to 4.0 mm. The reason why these ranges are effective will be described below:

The width (Wt) of each tube 1 should be in a range of 6.0 to 20 mm. As is evident from FIG. 7, if the width of the tubes is as small as less than 6.0 mm, the fins inserted between the tubes will be accordingly narrow in width. The narrow width of the fins limit the size and number of the louvers 2*a*, which reduces the efficient heat exchange. If the tubes 1 are as wide as beyond 20 mm, the fins will accordingly become large. The large fins increases pressure loss which the flowing air undergoes. In addition, the large fins increases the weight of the condenser. It is therefore preferred that the width is in the range of 6.0 to 16 mm, more preferably, 10 to 14 mm.

The height (Ht) of each tube 1 should be in a range of 1.5 to 7.0 mm. If it exceeds 7.0 mm, the pressure loss in the air flow increases. If it is less than 1.5 mm, it is difficult to increase the height (Hp) of the air paths to 1.0 mm or more because of the limited thickness of the tubes. It is preferred that it should be in the range of 1.5 to 5.0 mm; more preferably, 2.5 to 4.0 mm.

The height (Hp) of the cooling medium flow paths in the tubes 1 should be 1.0 mm or more. If it is less than 1.0 mm, the pressure loss in the cooling medium increases, thereby decreasing the rates of heat transfer. It is preferred that it is in the range of 1.5 to 2.0 mm.

Figure 9:
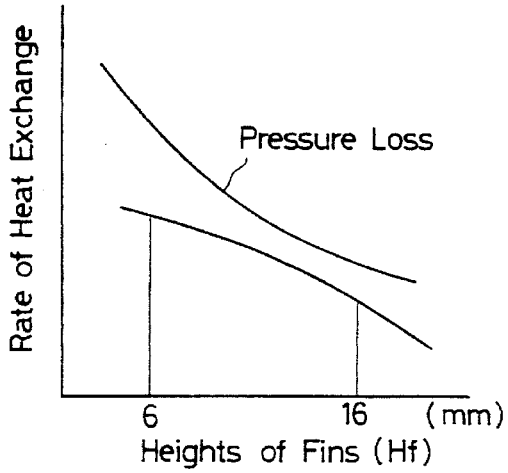
FIG. 9 is a graph showing a relationship among the heights of the fins, the rates of heat exchange and the pneumatic pressure loss.
Figure 10:
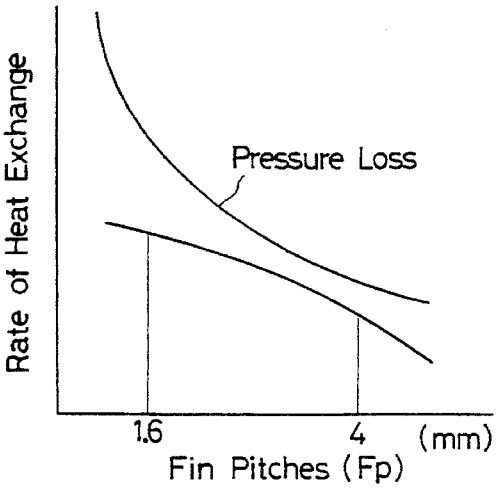
FIG. 10 is a graph showing a relationship among the fin pitches, the rates of heat exchange and the rates of heat transfer.

The height (Hf) of the corrugated fins 2 should be in the range of 6.0 to 16 mm. If it is less than 6 mm, the pressure loss in the air will increase as shown in FIG. 9. If it exceeds 16 mm, the number of total fins decreases, thereby reducing the efficiency of heat exchange. The optimum range is 8.0 to 12 mm.

The fin pitches should be in the range of 1.6 to 4.0 mm. If they are less than 1.6 mm, the louvers 2*a* interfere with the flow of the air, thereby increasing the pressure loss in the air flow. If they exceed 4.0 mm, the efficiency of heat exchange decreases. It is therefore preferred that the range is 1.6 to 3.2 mm; more preferably, 2.0 to 3.2 mm.

As is evident from the foregoing description, the plurality of flat tubes are stacked with the corrugated fins sandwiched therebeween, the tubes being connected to the headers at each end thereof. This construction advantageously eliminates the necessity of bending the tubes as is done with the serpentine type condensers. As a result, the condensers of the present invention are dimensionally flexible with respect to the widths of the tubes and the heights of the fins. Owing to the structural flexibility the widths and heights of the tubes, the heights of the cooling medium flow paths, the heights and pitches of the fin can be determined at optimum values so as to reduce the pressure losses which the air and the cooling medium undergo. The condenser of the present invention is applied not only to automobile air conditioing systems but also to building air conditioing systems. When it is used as a condenser for automobile, it will be of particular advantage because the condenser of the present invention can be well adapted for the recent relatively small air inlet in automobile without trading off the heat exchange efficiency.

What is claimed is:

1. A condenser comprising: a core; and a pair of headers provided in parallel with each other; the core including a plurality of flat tubes whose opposite ends are connected to the headers and corrugated fins provided in air paths present between one tube and the next, each tube having one or more internal reinforcing walls which connect an upper wall of the tube to a lower wall thereof, the opposite ends of the tubes being inserted in slits defined by the headers and liquid-tightly secured therein; the condenser having the following specifications:

width (Wt) of each tube: 6.0 to 20 mm height (Ht) of each tube: 1.5 to 7.0 mm height (Hp) of each cooling medium flow path: 1.0 mm or more height (Hf) of each fin: 6.0 mm to 16 mm fin (Fn) pitch: 1.6 to 4.0 mm;

the inner space of each header being divided by partition means for directing the cooling medium through the core in zigzag patterns, said partition means disposed in the inner space being without any perforations.

2. A condenser comprising: a core; and a pair of headers provided in parallel with each other; the core including a plurality of flat tubes whose opposite ends are connected to the headers and corrugated fins provided in air paths present between one tube and the next, each tube having one or more internal reinforcing walls which connect an upper wall of the tube to a lower wall thereof, the opposite ends of the tubes being inserted in slits defined by the headers and liquid-tightly secured therein; the condenser having the following specifications:

width (Wt) of each tube: 6.0 to 20 mm height (Ht) of each tube: 1.5 to 5.0 mm height (Hp) of each cooling medium flow path: 1.0 mm or more height (Hf) of each fin: 8.0 mm to 16 mm fin (Fn) pitch: 1.6 to 3.2 mm;

the inner space of each header being divided by partition means for directing the cooling medium through the core in zigzag patterns, said partition means disposed in the inner space being without any perforations.

3. A condenser comprising: a core; and a pair of headers provided in parallel with each other; the core including a plurality of flat tubes whose opposite ends are connected to the headers and corrugated fins provided in air paths present between one tube and the next, each tube having one or more internal reinforcing walls which connect an upper wall of the tube to a lower wall thereof, the opposite ends of the tubes being inserted in slits defined by the headers and liquid-tightly secured therein; the condenser having the following specifications:

width (Wt) of each tube: 10 to 14 mm height (Ht) of each tube: 2.5 to 4.0 mm height (Hp) of each cooling medium flow path: 1.5 mm to 2.0 mm height (Hf) of each fin: 8.0 mm to 12 mm fin (Fn) pitch: 2.0 to 3.2 mm;

the inner space of each header being divided by partition means for directing the cooling medium through the core in zigzag patterns, said partition means disposed in the inner space being without any perforations.

4. A condenser as defined in claim 1, wherein the corrugated fins are provided with louvers on their surface.

5. A condenser as defined in claim 1, wherein each of the headers is made of aluminum pipes having a circular cross-section.

6. A condenser as defined in claim 1, wherein each of the tubes is provided with means for preventing the tube from being inserted too far into the headers.

7. A condenser as defined in claim 5, wherein the aluminum pipe is an electrically seamed pipe.

8. A condenser as defined in claim 5, wherein the aluminum pipe is made of an extruded aluminum.

* * * * *